US005396219A

United States Patent [19]

Chen

[11] Patent Number: 5,396,219

[45] Date of Patent: * Mar. 7, 1995

[54] SECURITY DEVICE FOR PROTECTION AGAINST PICKPOCKETS

[76] Inventor: Lily Chen, 1F., No.4, Alley 8, Lane 265, Lian-Cherng RD., Jong-Her City, Taipei Shine, Taiwan, Prov. of China

[ * ] Notice: The portion of the term of this patent subsequent to Mar. 7, 2010 has been disclaimed.

[21] Appl. No.: 805,654

[22] Filed: Dec. 12, 1991

[51] Int. Cl.[6] ..... G08B 13/14; A45C 1/06

[52] U.S. Cl. ..... 340/571; 150/134

[58] Field of Search ..... 340/571, 568; 200/61.76, 61.77, 61.19; 224/230, 194, 252; 24/3 H, 3 L; 150/134; 70/19

[56] References Cited

U.S. PATENT DOCUMENTS

| | | | |
|---|---|---|---|
| 3,815,118 | 6/1974 | McDonald | 340/571 |
| 3,822,446 | 7/1974 | Silverstein | 24/3 H |
| 4,080,595 | 3/1978 | Rosen | 340/568 |
| 4,090,183 | 5/1978 | Miller | 340/571 |
| 4,908,607 | 3/1990 | Yannotti et al. | 340/571 |
| 5,031,281 | 7/1991 | Devylder | 24/34 |

FOREIGN PATENT DOCUMENTS

| | | | |
|---|---|---|---|
| 3150565 | 6/1983 | Germany | 150/134 |

*Primary Examiner*—Jin F. Ng
*Assistant Examiner*—Thomas J. Mullen, Jr.

[57] ABSTRACT

A security device for protection against pickpockets comprising a clamp intended to be releasably clamped on a top edge of a pocket and connected to a card-size casing by a flexible connecting element is disclosed. The card-size casing is adapted to be received in a compartment inside a purse which, in turn, is received in the pocket such that pulling the purse out of the pocket causes a lock bolt on the clamp to tightly secure the clamp to the pocket. A pull rod is movably fastened in the casing and connected to the flexible connecting element to trigger an alarm circuit when the casing is pulled outwards.

8 Claims, 8 Drawing Sheets

SECURITY DEVICE FOR PROTECTION AGAINST PICKPOCKETS

BACKGROUND OF THE INVENTION

The present invention relates to security devices and relates more particularly to a security device to be kept in a purse for protection against pickpockets.

While shopping, taking a bus or train, or passing through any place where crowds are gathering, one shall have to watch and guard one's money purse carefully so as to protect against pickpockets. Simply holding a money purse in a handbag carried on one's shoulder is still not safe. A pickpocket may use a cutter to cut open the handbag and then steal the money purse from the handbag. Although there are several alarm devices disclosed for protection against. burglars, they are commonly designed for fighting against burglars or deterring burglars from attacking.

SUMMARY OF THE INVENTION

The present invention has been accomplished in view of the aforesaid circumstances. It is therefore the main object of the present invention to provide a security device which can effectively protect a purse from being stolen by a pickpocket.

According to one aspect of the present invention, there is provided a security device generally comprised of a casing to be received in a purse, a clamp to be clamped on a pocket, and a chain connected between the casing and the clamp. The clamp has a lock bolt rotated on an axle within two opposite dead points on a slot on a clamping plate to be clamped on a pocket. Pulling the purse in which the casing is kept causes the lock bolt to firmly secure the clamping plate to the pocket.

According to an alternate form of the present invention, the casing has a pull rod connected to the chain, and an alarm circuit controlled by a switch to produce an audio alarm, wherein the alarm circuit is electrically connected when the pull rod is pulled out of the casing by the chain, or electrically disconnected when the pull rod is pushed back into the casing.

According to another alternate form of the present invention, the casing has a detecting rod movably inserted in an elongated hole thereon and supported by a spring. The detecting rod is pushed out of the casing by the spring to electrically connect the alarm circuit causing it to produce an audio alarm when the purse in which the casing is kept is pulled out of a pocket by a pickpocket. The alarm circuit is electrically disconnected when the casing is kept in place causing the detecting rod to be received inside the casing.

According to still another alternate form of the present invention, the detecting rod has a protruding end disposed out of the casing and attached with a toothed pawl element which hooks in a pocket to secure the casing to said pocket.

DETAILED DESCRIPTION OF THE PREFERRED EMBODIMENTS

Figure 1:
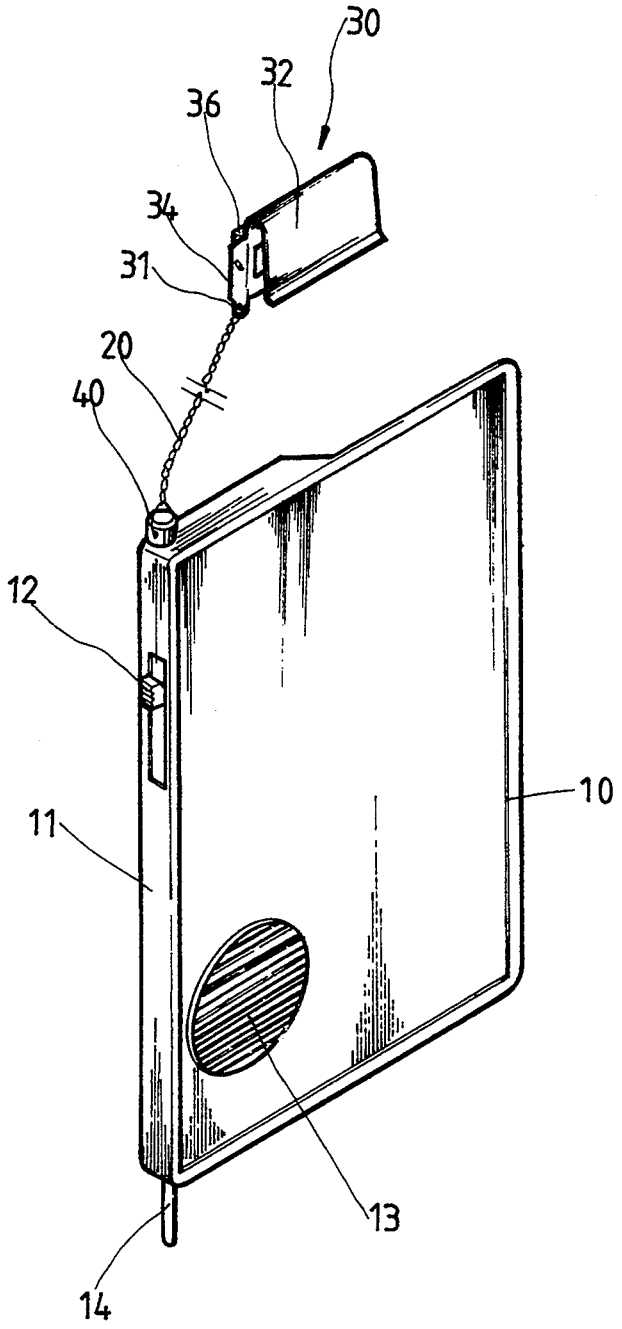
FIG. 1 is a perspective view of a security device embodying the present invention.

Referring to FIG. 1, a security device according to the present invention is generally comprised of a flat, rectangular casing 10 having a vertical side wall 11 in a suitable thickness. In an embodiment of the present invention (without having the slip switch 12, the buzzer 13 and the detecting rod 14 as shown in FIG. 1), a flexible cord or chain 20 is connected between a pull rod 40 on the casing 10 and a corner edge 31 on a clamp 30. The chain 20 may be directly connected to a corner edge on the casing 10 (not connected to the pull rod 40).

Figure 2:
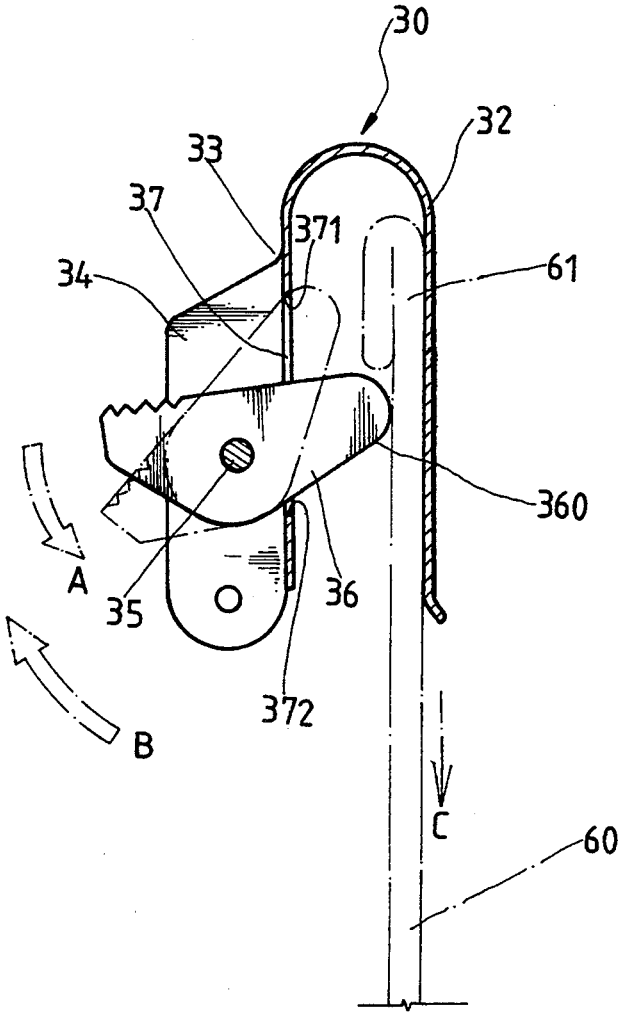
FIG. 2 is a side plan view of the clamp showing its locking operation in fastening to a pocket.

Referring to FIG. 2, the clamp 30 is comprised of a substantially U-shaped clamping plate 32 having two unitary side strips 34 on an outer surface 33 thereof at two opposite ends, an axle 35 connected between said two side strips 34, and a lock bolt 36 mounted on said axle 35. The lock bolt 36 can be rotated on the axle 35 and moved through a slot 37 on the outer surface 33 into an internal space defined within the U-shaped clamping plate 32, wherein said slot 37 has an upper dead point 371 and a lower dead point 372.

Figure 8:
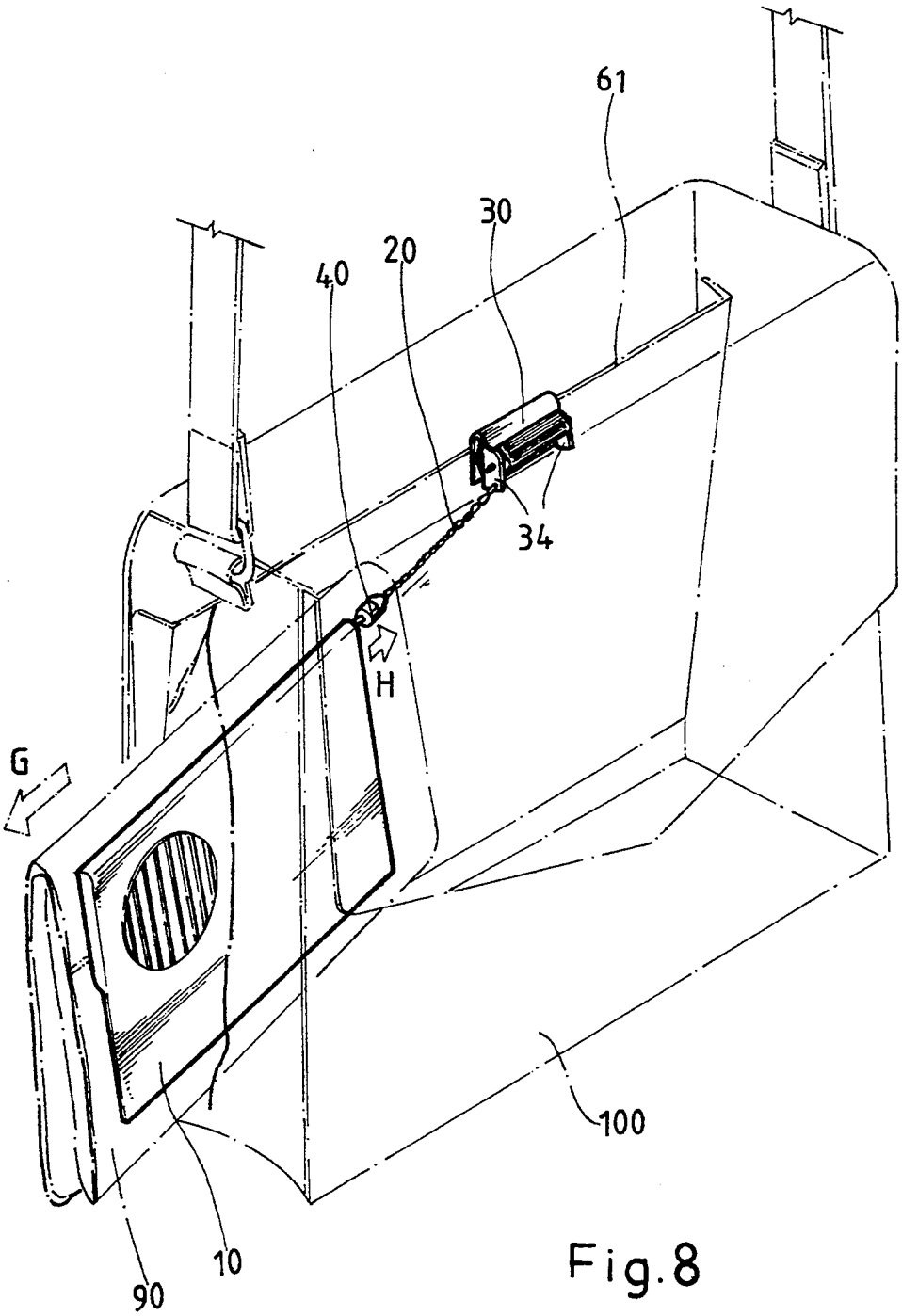
FIG. 8 illustrates the operation of the present invention when a purse is removed from a handbag.

Referring to FIG. 8 and seeing FIG. 2 again, when the casing 10 is put in a compartment inside a purse 90 (see FIG. 8), the U-shaped clamping plate 32 of the clamp may be clamped on a pocket 60 at a top edge 61 thereof. The lock bolt 36 is rotated into a locking position (as indicated in the rear line in FIG. 2) to tightly secure the clamp 30 to the pocket 60. If the lock bolt 36 is rotated in direction "A", it is immediately moved away from the locking position and then, retained at the upper dead point 371 (see the dotted line in FIG. 2). If a pickpocket steals the purse 90 from the pocket 60, the lock bolt 36 will be pulled in direction "B", while the purse 90 is taken out of the pocket 60, causing the pocket 60 to displace in direction "C", and therefore, a bottom edge 360 of the lock bolt 36 will be moved to stop against the lower dead point 372. Therefore, when stronger pull force is applied at the clamp 30, the lock bolt 36 will lock up the pocket 60 more firmly. Pulling the clamp 30 upwards and outwards from the pocket 60 can not remove the clamp 30 from place but cause the clamp 30 to increase its clamping force on the pocket 60. Since the clamp 30 can only be removed from the pocket by rotating the bottom edge 360 of the lock bolt 36 upwards toward the upper dead point 371, the owner who carries the handbag 100 and the purse 90 will be greatly touched if a pickpocket inserts the finger into the pocket 60 to release the lock bolt 36. Therefore, the present invention makes the process of stealing difficult and can effectively protect a purse from being stolen.

Figure 3:
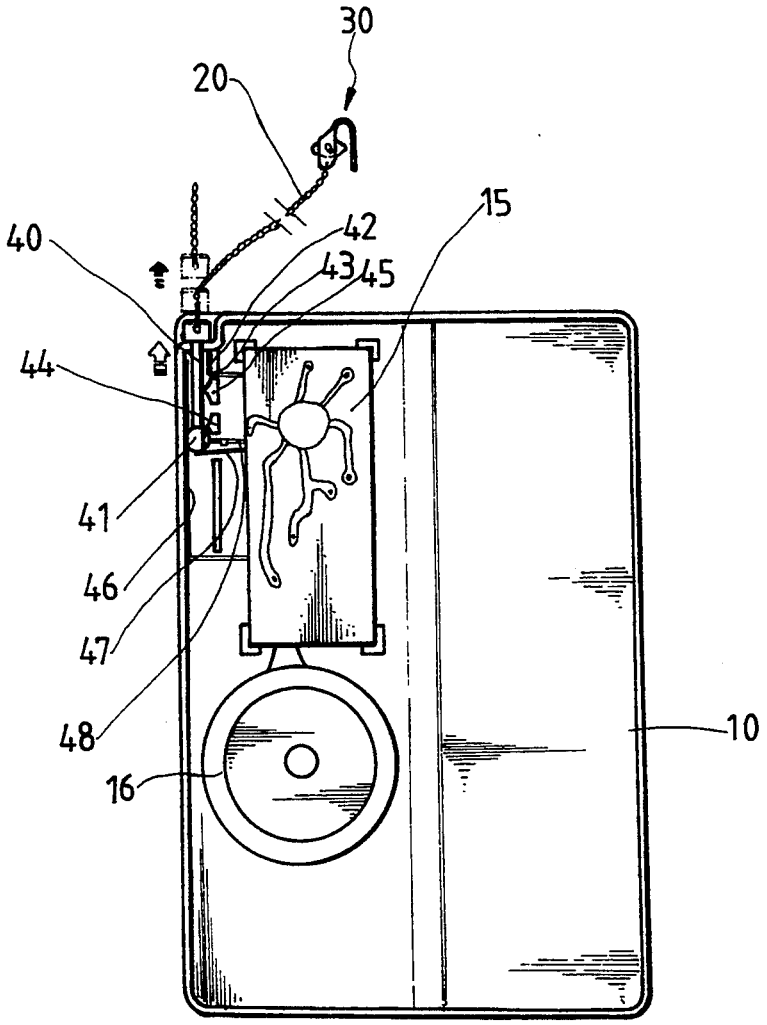
FIG. 3 is a front sectional view of an alternate form of the present invention showing that the clamp is connected to a pull rod on the casing by a chain.

Referring to FIG. 3, therein illustrated is a second embodiment of the present invention. In this alternate embodiment, the chain 20 is connected between the clamp 30 and a pull rod 40 on the casing 10, and the casing 10 has a PC board 15 and a buzzer 16 fastened therein. The pull rod 40 has a knob 41 at a bottom end thereof inserted into a narrow, elongated chamber 42 at one side inside the casing 10 and stopped at a spring 47. The spring 47 is off when it is pressed by the knob 41 of the pull rod 40. The chamber 42 has two raised points 43, 44 at one side, a contact strip 45 on the raised point 43, another contact strip 46 at an opposite side. The contact strips 45, 46 are respectively connected to the PC board 15. When the pull rod 40 is pulled upwards to a first step position (above the lower raised point 44), the spring 47 is moved to contact a contact strip 48. When the pull rod 40 is continuously pulled upwards to a second step position (above the upper raised point 43), the knob 41 of the pull rod 40 simultaneously contacts the contact strips 45, 46, causing the buzzer 16 to buzz. Therefore, when the casing 10 is placed inside a purse and pulled outwards, the pull rod 40 will be moved to trigger the buzzer 16 causing it to produce an audio alarm. Further a slip switch 12 (see FIG. 1) may be attached to the casing 10 for controlling the position of the pull rod 40 in the casing 10.

Figure 4:
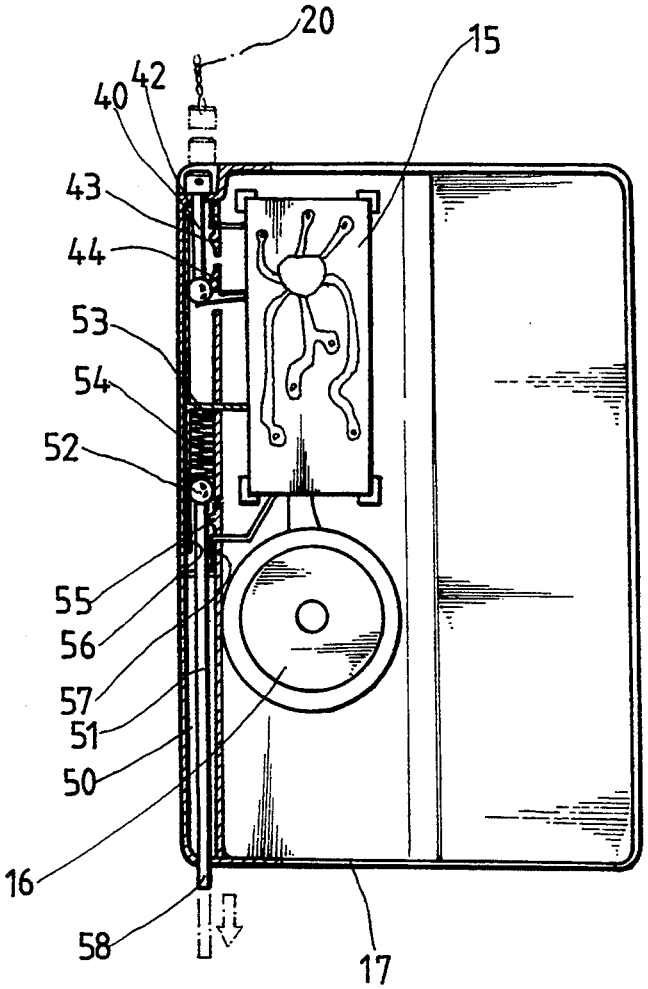
FIG. 4 is a front sectional view of still another alternate form of the present invention in which a detecting rod is movably fastened in the casing.
Figure 6:
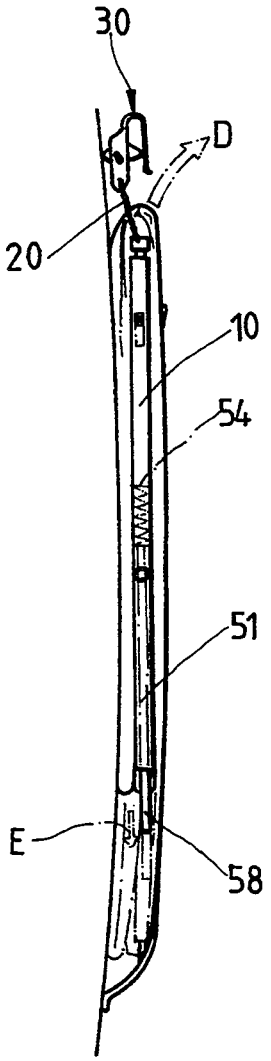
FIG. 6 illustrates the operation of the embodiment of the security device of FIG. 4 when it is received in a narrow pocket.

Referring to FIG. 4, therein illustrated is another alternate form of the present invention. In this embodiment, the casing 10 has a detecting rod 51 inserted in a narrow, elongated chamber 50. The detecting rod 51 has a knob 52 at one end stopped against a compression spring 54 which is supported on an edge 53 inside the chamber 50. The detecting rod 51 has an opposite end 58 disposed out of a bottom edge 17 of the casing 10. The chamber 50 has a raised point 55 at one side, a contact strip 56 at an opposite side, another contact strip 57 below said raised point 55. Both contact strips 56, 57 are respectively connected to the PC board 15. When the casing 10 is kept in a purse, the end 58 will be forced by the purse to completely move into the chamber 50, causing the knob 52 to compress the compression spring 54. If the purse is pulled in direction "D" (see FIG. 6), the pressure on the end 58 is released, and therefore, the end 58 of the detecting rod 51 is immediately forced by the compression spring 54 to extend outwards in direction "E" causing the knob 52 to connect the contact strips 56, 57. When the contact strips 56, 57 are connected, the buzzer 16 is triggered to produce an audio alarm.

Figure 5:
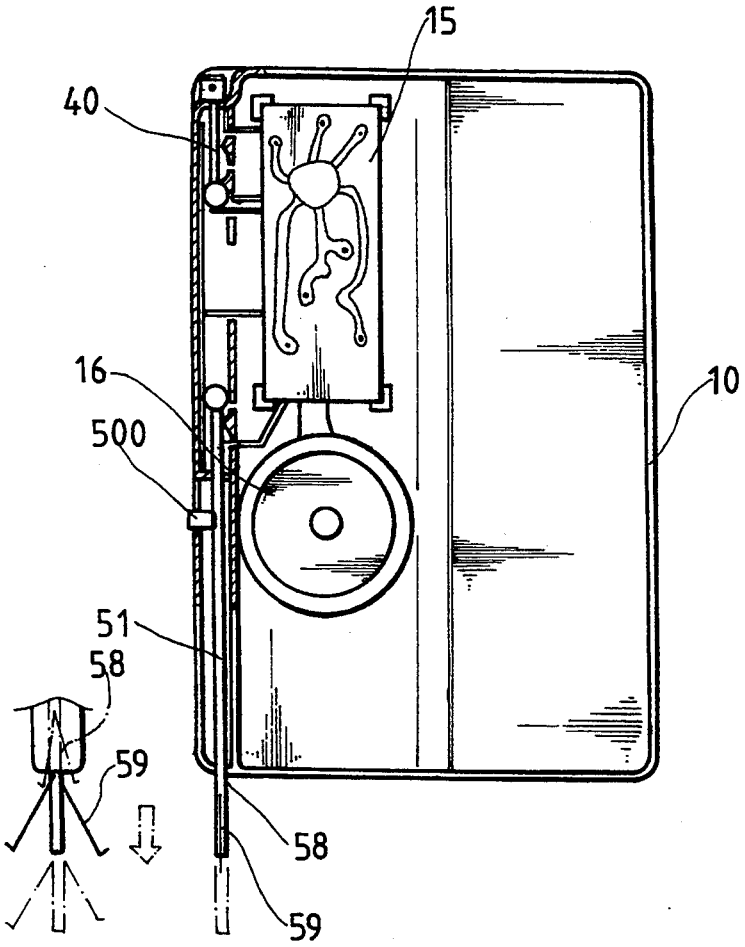
FIG. 5 is another front sectional view of the embodiment of FIG. 4 showing that the detecting rod is attached to a pawl-like spring.
Figure 7:
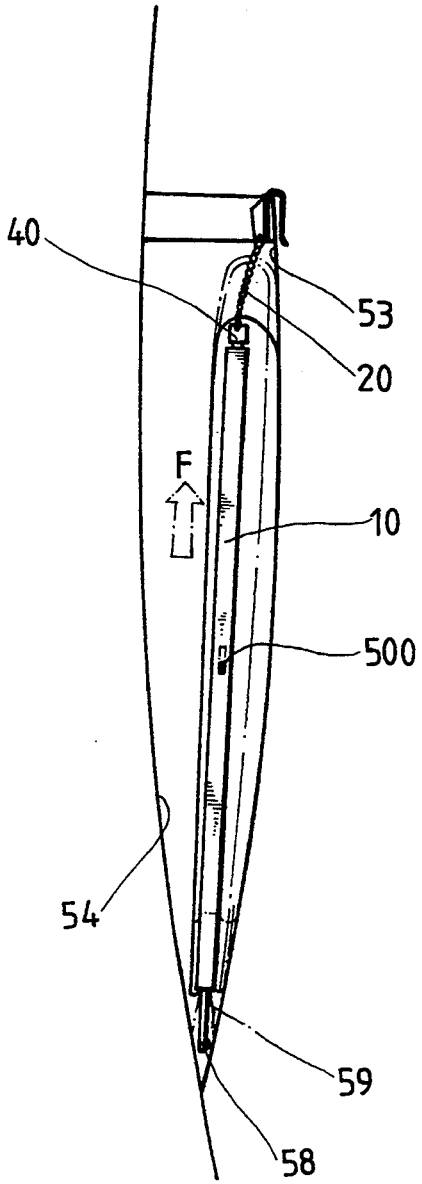
FIG. 7 illustrates the operation of the embodiment of the security device of FIG. 4 when it is received in a loose pocket.

Referring to FIGS. 5 and 7, therein illustrated is still another alternate form of the present invention for use in a loose pocket. In this embodiment, the end 58 of the detecting rod 51 is attached with a pawl-like spring leaf 59 which has fine teeth on the terminal ends thereof. When the purse is pulled upwards in direction "F", the spring leaf 59 is caused to rub against two opposite side panels 53, 54 of a pocket, and therefore, the detecting rod 51 is moved downwards relative to the casing 10, to electrically connect the alarm circuit (the buzzer). In this embodiment, the compression spring is eliminated. A slide 500 may be attached to the casing 10 at the outside for moving the detecting rod 51 with the hand.

FIG. 8 illustrates the use of the present invention in securing a purse 90 to a handbag 100. The casing 10 is received in a compartment inside the purse 90 which is received inside the handbag 100, and the clamp 30 is clamped on a peripheral edge of a compartment inside the handbag 100. When the purse 90 is pulled outwards in direction "G", the chain 20 will produce a pull force in direction "H" causing the pull rod 40 to be pulled out of the casing 10, and therefore the buzzer in the casing 10 will be triggered to produce an audio alarm.

What is claimed is:

1. A security device, comprising:

a casing, said casing having a vertical side wall of a thickness enabling said casing to be inserted in a pocket;

a clamp comprising a clamping plate adapted to be clamped on said pocket, a lock bolt, means for pivotally mounting said lock bolt on said clamping plate to firmly secure said clamping plate on the pocket, said clamping plate having a slot through which a portion of said lock bolt extends, said slot defining an upper dead point and a lower dead point for the pivoting of said lock bolt; and a flexible connecting element connected between said casing and said clamp;

wherein pulling said casing away from the pocket causes said lock bolt to be rotated in a direction toward said lower dead point so as to firmly secure said clamp on the pocket; and rotating said lock bolt from said lower dead point toward said upper dead point causes said clamp to be released from the pocket.

2. The security device of claim 1, wherein said clamping plate is U-shaped and includes two unitary side strips on an outer surface thereof at two opposite ends, said clamp further comprising an axle connected between said two side strips, and Said lock bolt being mounted on said axle and extending through said slot, which is formed in said outer surface into a cavity defined by said U-shaped clamping plate.

3. The security device of claim 1, wherein said flexible connecting element has one end connected to said clamp and an opposite end connected to a pull rod which is inserted into a narrow chamber in said casing, said casing having an alarm circuit controlled by a switch to produce an audio alarm, said switch being electrically connected when said pull rod is pulled out of said casing and electrically disconnected when said pull rod is pushed back inside said casing.

4. The security device of claim 3, wherein said chamber has two raised locating points at two spaced positions; said switch comprises two conductive strips fastened inside said chamber above said raised locating points and electrically connected by a knob at one end of said pull rod when said pull rod is moved outwards.

5. The security device of claim 3, wherein said casing has a slide at the outside for moving said pull rod by hand.

6. The security device of claim 1, wherein said casing has a detecting rod movably inserted in an elongated hole on a bottom thereof and supported by a spring, and an alarm circuit controlled by said detecting rod to produce an audio alarm, said alarm circuit being electrically disconnected when a pressure is applied at said detecting rod causing it to be concealed inside said hole, said alarm circuit being electrically connected when said pressure is released from said detecting rod causing it to be pushed by said spring to extend out of said casing.

7. The security device of claim 6, wherein said hole has a raised point and two opposite conductive strips on an inner wall thereof, said conductive strips being connected by said detecting rod to trigger said alarm circuit when said detecting rod is located below said raised point, said conductive strips being disconnected to stop said alarm circuit when said detecting rod is located above said raised point.

8. The security device of claim 1, wherein said casing has a detecting rod movably inserted in an elongated hole on a bottom thereof, an alarm circuit controlled by a switch to produce an audio alarm, and a slide to move said detecting rod in said elongated hole by hand, said detecting rod having one end disposed out of said casing and attached with a toothed pawl means for hooking in the body of a pocket, said switch being connected when said detecting rod is pulled out of said casing and disconnected when said detecting rod is pushed back into said casing.

* * * * *